US010039943B2

(12) United States Patent
Meis et al.

(10) Patent No.: US 10,039,943 B2
(45) Date of Patent: Aug. 7, 2018

(54) AIRCRAFT FIRE SUPPRESSION

(71) Applicant: The Boeing Company, Chicago, IL (US)

(72) Inventors: Charles Steven Meis, Renton, WA (US); David John Shaw, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 1201 days.

(21) Appl. No.: 13/744,409

(22) Filed: Jan. 17, 2013

(65) Prior Publication Data

US 2014/0202718 A1 Jul. 24, 2014

(51) Int. Cl.

| | |
|---|---|
| ***A62C 3/06*** | (2006.01) |
| ***A62C 3/08*** | (2006.01) |
| ***A62C 37/36*** | (2006.01) |
| ***A62C 35/08*** | (2006.01) |
| *A62C 35/11* | (2006.01) |

(52) U.S. Cl.

CPC ..... *A62C 3/08* (2013.01); *A62C 35/08* (2013.01); *A62C 37/36* (2013.01); *A62C 35/11* (2013.01)

(58) Field of Classification Search

CPC A62C 3/08; A62C 35/11; A62C 37/36; A62C 35/68; A62C 3/06; A62C 99/0018; A62C 3/00; A62C 37/10; A62C 3/065; A62C 3/07; A62C 35/605

USPC ..... 169/46, 53, 60, 56, 54, 62, 61, 45, 11, 169/16, 70, 15, 9, 19

See application file for complete search history.

(56) References Cited

U.S. PATENT DOCUMENTS

| | | | | |
|---|---|---|---|---|
| 7,117,950 | B2 | 10/2006 | McLane, Jr. | |
| 7,510,022 | B2 * | 3/2009 | Lazzarini | 169/70 |
| 2002/0070035 | A1 * | 6/2002 | Grabow et al. | 169/16 |
| 2003/0136879 | A1 * | 7/2003 | Grabow et al. | 244/129.2 |
| 2004/0056765 | A1 * | 3/2004 | Anderson | A62C 35/08 340/522 |
| 2005/0139366 | A1 * | 6/2005 | Scheidt | 169/60 |
| 2005/0150663 | A1 * | 7/2005 | Fabre | A62C 13/66 169/43 |
| 2010/0236796 | A1 * | 9/2010 | Chattaway | A62C 37/44 169/46 |
| 2011/0048747 | A1 * | 3/2011 | Gastonides et al. | 169/66 |

FOREIGN PATENT DOCUMENTS

| | | |
|---|---|---|
| EP | 1616599 B1 | 2/2009 |

* cited by examiner

*Primary Examiner* — Arthur O Hall
*Assistant Examiner* — Tuongminh Pham
(74) *Attorney, Agent, or Firm* — Miller, Matthias & Hull LLP

(57) ABSTRACT

An aircraft comprises a fuselage having a compartment, and a fire suppression system for delivering fire suppressant to the compartment. The system includes at least one suppressant concentration sensor located in the compartment, a valve for regulating flow of the fire suppressant to the compartment, and a controller, responsive to the sensor, for controlling the valve to maintain fire suppressant concentration within the compartment at a target concentration.

14 Claims, 6 Drawing Sheets

AIRCRAFT FIRE SUPPRESSION

BACKGROUND

Commercial aircraft may be equipped with fire suppression systems for suppressing fires in cargo compartments. A conventional aircraft fire suppression system responds to a fire alarm in two phases: a "quick knockdown" phase, followed by a suppression phase. During the quick knockdown phase, a cargo compartment is flooded with fire suppressant at a high flow rate. During the suppression phase, a lower flow rate of fire suppressant into the cargo compartment is provided over an extended period of time.

A fire suppression system adds weight to an aircraft. The added weight increases fuel costs. It would be desirable to reduce the weight of a fire suppression system.

SUMMARY

According to an embodiment herein, an aircraft comprises a fuselage having a compartment, and a fire suppression system for delivering fire suppressant to the compartment. The system includes at least one suppressant concentration sensor located in the compartment, a valve for regulating flow of the fire suppressant to the compartment, and a controller, responsive to the sensor, for controlling the valve to maintain fire suppressant concentration within the compartment at a target concentration.

According to another embodiment herein, a fire suppression system for delivering a fire suppressant to a compartment of an aircraft comprises at least one suppressant concentration sensor located in the compartment, at least one valve for regulating flow of the fire suppressant to the compartment, and a controller, responsive to the sensor, for controlling the at least one valve to maintain fire suppressant concentration within the compartment at a target concentration.

According to another embodiment herein, a method of suppressing a fire in a cargo compartment of an aircraft comprises sensing concentration of fire suppressant in the compartment, and controlling the fire suppressant to a target concentration.

These features and functions may be achieved independently in various embodiments or may be combined in other embodiments. Further details of the embodiments can be seen with reference to the following description and drawings.

DETAILED DESCRIPTION

Figure 1:
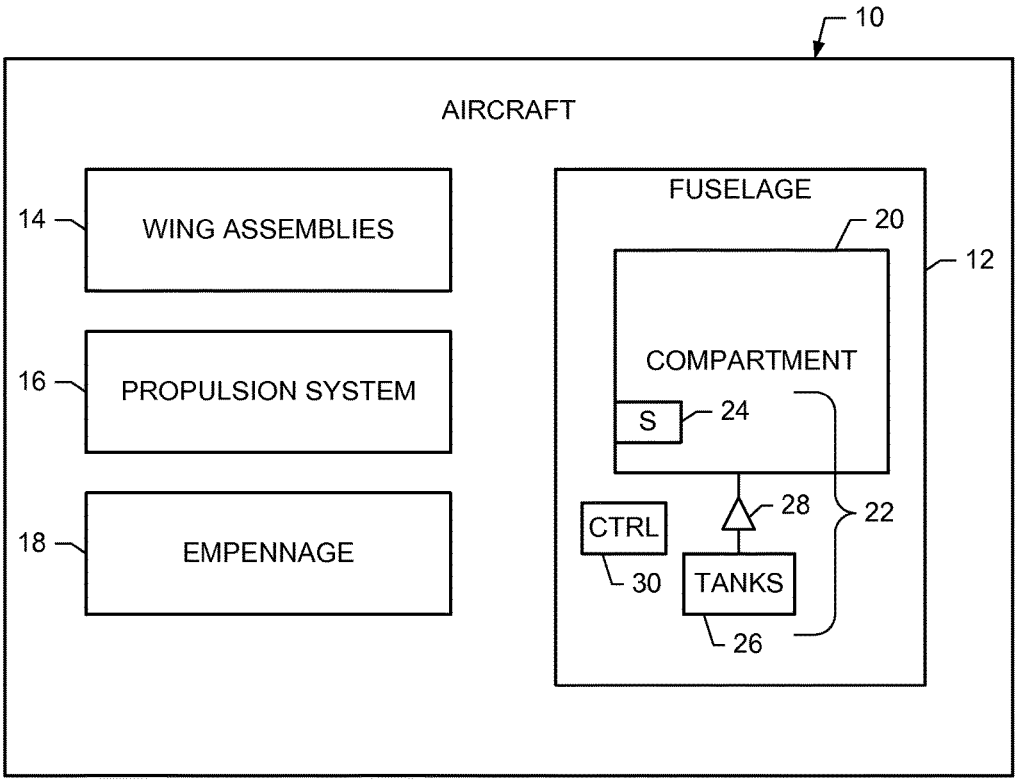
FIG. 1 is an illustration of an aircraft equipped with a fire suppression system.

FIG. 1 illustrates an aircraft 10 including a fuselage 12, wing assemblies 14, a propulsion system 16, and empennage

18. The fuselage 12 includes at least one interior compartment 20 (e.g., cargo compartments). The aircraft 10 further includes a fire suppression system 22 including one or more tanks 26 for storing a fire suppressant (e.g., Halon 1301), one or more valves 28 for regulating flow of the fire suppressant to the compartment 20, and a controller 30. When a fire is detected in a compartment 20, the system 22 is activated (either automatically or manually), whereby the controller 30 controls the valve(s) 28 to regulate a flow of fire suppressant into that compartment 20. In some embodiments, the fire suppression system 22 may be activated only while the aircraft 10 is in flight.

During fire suppression, the concentration of the fire suppressant in the compartment 20 may be reduced over time due to aircraft level air-flow management. Air and, therefore, suppressant can leak out of the cargo compartment. Airflow patterns, including cargo heat systems, recirculation systems and air conditioning pack flow can affect the amount of air (and thus fire suppressant) being driven out of door seals, seams in cargo liners etc.

The fire suppression system 22 further includes at least one suppressant concentration sensor 24 located in the compartment 20. The sensor 24 may be a commercially available gas sensor that draws a small amount of air into a chamber and then physically tests the air for suppressant concentration. Each sensor 24 measures the concentration of the fire suppressant in the compartment 20 and sends measurements to the controller 30. In response to the concentration measurements, the controller 30 controls the valve(s) 28 to maintain the fire suppressant concentration within the compartment 20 at a target concentration. The target concentration may be determined by regulations.

The controller 30 may be located outside the compartment 20 (e.g., in the aircraft's flight deck or electronics bay). The tanks 26 may be located just outside the compartment 20 (e.g., along a side of the fuselage 10, or at an aft end of a compartment 20). If the aircraft has multiple compartments 20, the suppression system 22 may be plumbed to all of the compartments 20.

Figure 2:
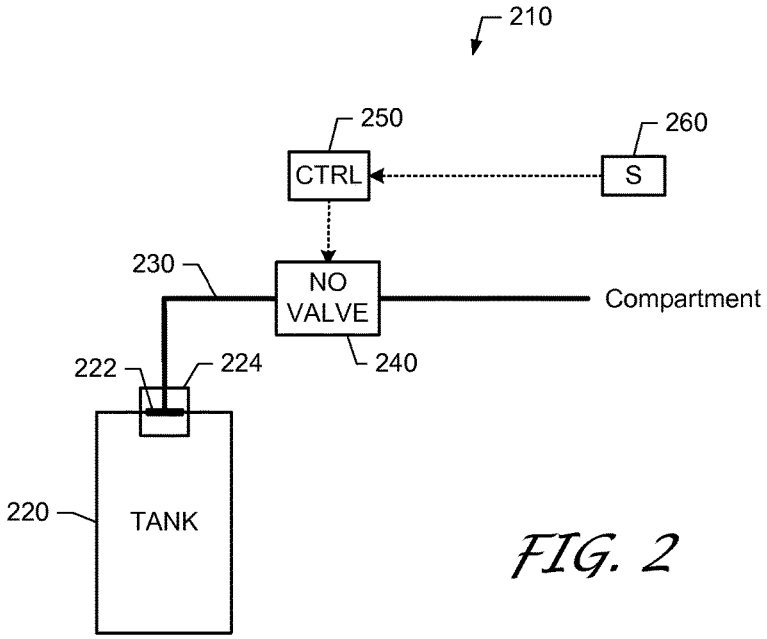
FIGS. 2 and 3 are illustrations of examples of the fire suppression system.

By measuring the suppressant concentration within the compartment 20 and maintaining the suppressant at the target concentration during fire suppression, suppressant usage is optimized. Optimizing suppressant usage enables the number and/or size of the tanks 26 to be reduced. This, in turn, reduces weight of the system 22 and, consequently, reduces operating cost of the aircraft 10. Reducing the number of tanks 26 also reduces the complexity of plumbing the fire suppressant to the compartment 20 (e.g., fewer valves and less conduit are used). In addition, by optimizing the suppressant usage, the environmental impacts of a suppressant agent discharge into the atmosphere is minimized FIG. 2 illustrates an example of a fire suppression system herein. The fire suppression system 210 of FIG. 2 includes a single tank 220 for storing a fire suppressant. An outlet port of the tank 220 may be sealed, for example, with a diaphragm 222. When the system 210 is activated, the tank seal is broken to allow fire suppressant to flow out of the tank 220. For example, the diaphragm 222 may be punctured by a pyrotechnic discharge head (e.g., a squib) 224. A conduit 230 communicates the tank outlet port to a regulating valve 240, which regulates the flow of the fire suppressant to a compartment. In this example, the valve 240 is a normally-open (NO) valve.

A controller 250 is configured to adjust the position of the valve 240 to achieve a relatively high flow rate of the suppressant during a quick knockdown phase of operation and, after a predetermined time interval has elapsed, cause the valve 240 to close partially to achieve a second, lower flow rate during a suppression phase of operation. The controller 250 receives a signal from a concentration sensor 260 located in the compartment. The signal indicates a measured concentration level of the fire suppressant in the compartment. The controller 250 uses that signal to adjust the valve position to regulate the suppressant flow rate so that the measured concentration is maintained at a target concentration during both the quick knockdown and suppression phases.

Figure 4:
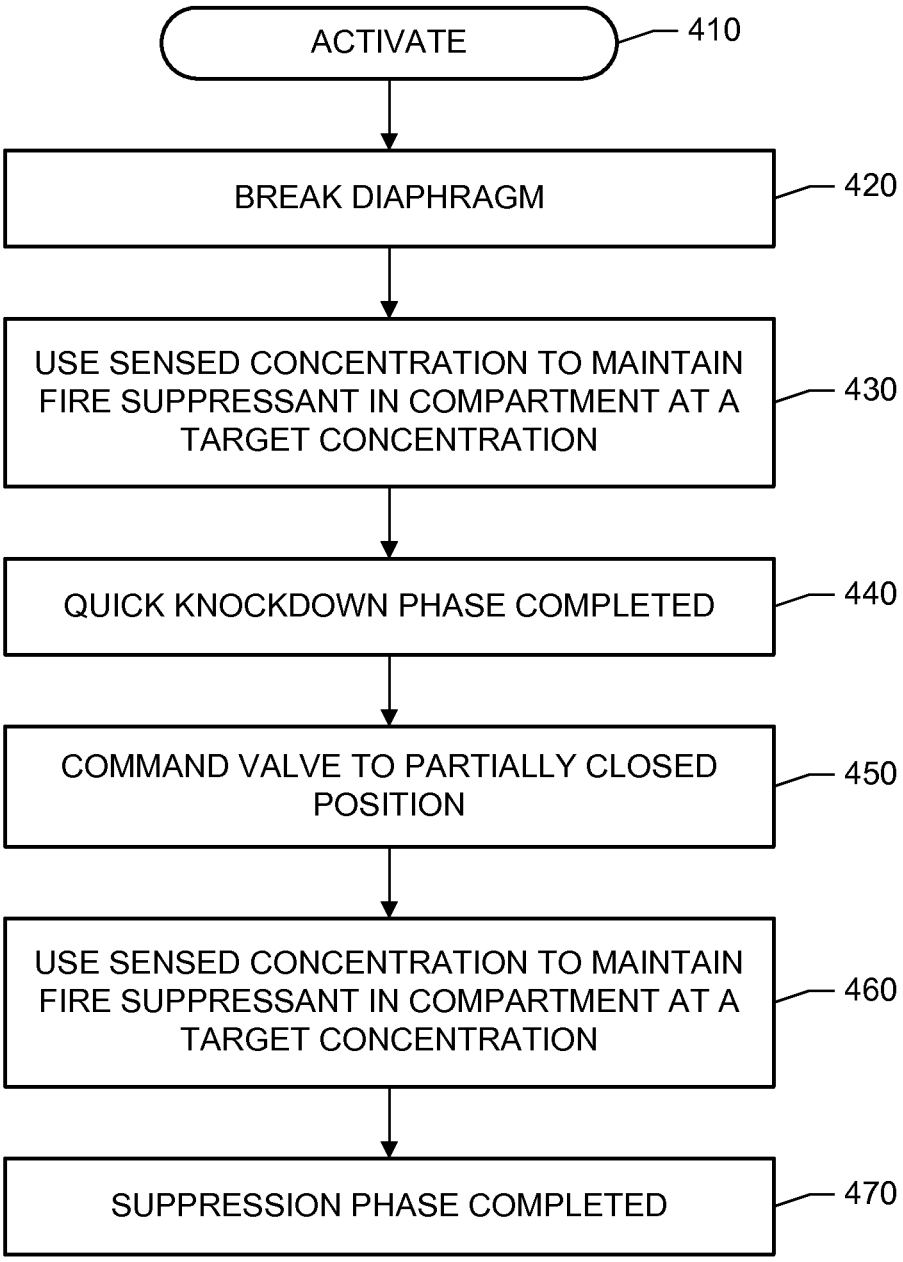
FIGS. 4 and 5 are illustrations of methods of operating the fire suppression systems of FIGS. 2 and 3, respectively.

FIG. 4 illustrates the operation of fire suppression system 210. The controller 250 is in a state of readiness until an "activate" command is received (block 410). When the activate command is received, the controller 250 causes the pyrotechnic discharge head 224 to break the diaphragm 222 (block 420). This action results in the tank 220 immediately opening and providing fire suppressant via the conduit 230 to the regulating valve 240. Since the regulating valve 240 is a normally-open valve, a full flow of fire suppressant is provided to the compartment. In this manner, the quick knockdown phase of fire suppression is initiated.

During the quick knockdown phase, the concentration sensor 260 measures concentration of the fire suppressant in the compartment, and sends measurements to the controller 250. In response, the controller 250 adjusts the position of the valve 240 to achieve a flow rate that maintains the measured suppressant concentration at a target concentration (block 430).

In some embodiments, the quick knockdown phase is implemented until a predetermined time interval has elapsed (block 440). For instance, a countdown timer may be initiated by the controller 250 after the diaphragm 222 has been broken. This countdown timer may have a pre-selected interval that depends on design factors such as the volume of compartment, the volume of tank 220, the flow rate of fire suppressant into the compartment, and the nature of the cargo stored in the compartment, among other factors. In other embodiments, the quick knockdown phase may be implemented until sensed conditions (e.g., suppressant concentration) within the compartment indicate that quick knockdown is no longer needed (block 440).

At the end of the quick knockdown phase, the controller 250 commands the regulating valve 240 to a pre-selected partially closed position (block 450). This partial closure of the valve 240 begins the suppression phase of operation. Thus, a lower flow rate of fire suppressant is maintained. During the suppression phase, the concentration sensor 260 measures concentration of the suppressant in the compartment, and sends measurements to the controller 250. In response, the controller 250 adjusts the position of the valve 240 to achieve a flow rate that maintains the measured suppressant concentration at a target concentration (block 460). The suppressant concentration may be controlled until the suppression phase has been completed (block 470).

Figure 3:
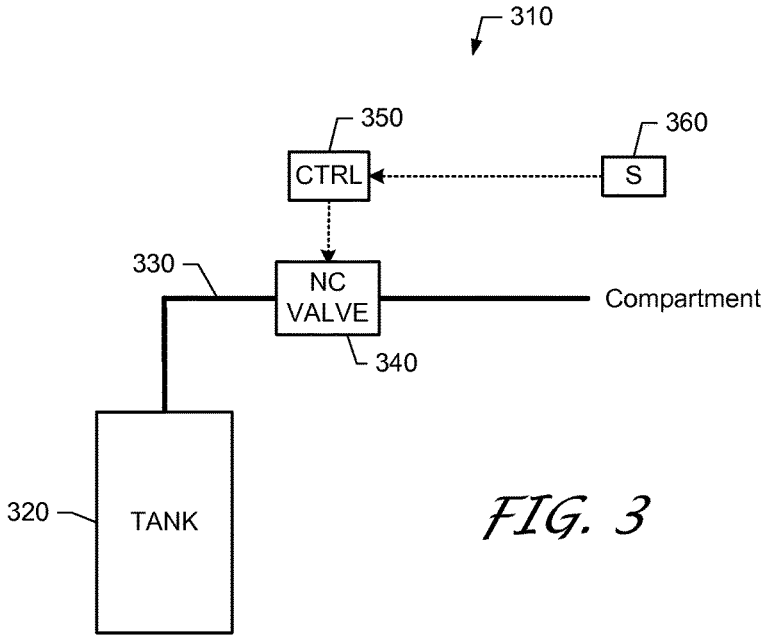

FIG. 3 illustrates another example of a fire suppression system herein. The fire suppression system 310 of FIG. 3 includes at least one tank 320 for storing a fire suppressant, a conduit 330, and a regulating valve 340 for regulating the flow of fire suppressant from the tank(s) 320 through the conduit 330 to a compartment. In this example, the valve 340 is a normally closed (NC) valve.

When the system 310 is activated, a controller 350 causes the valve 340 to open fully during an initial quick knockdown phase of operation and, after a predetermined time interval has elapsed, causes the valve 340 to be partially open during a suppression phase of operation. The controller 350 uses a signal from a concentration sensor 360 to adjust the valve position so that measured concentration in the compartment is maintained at a target concentration. By using a normally closed valve 340 instead of a normally open valve 240, the tank 320 need not be sealed, and a seal need not be broken.

Figure 5:
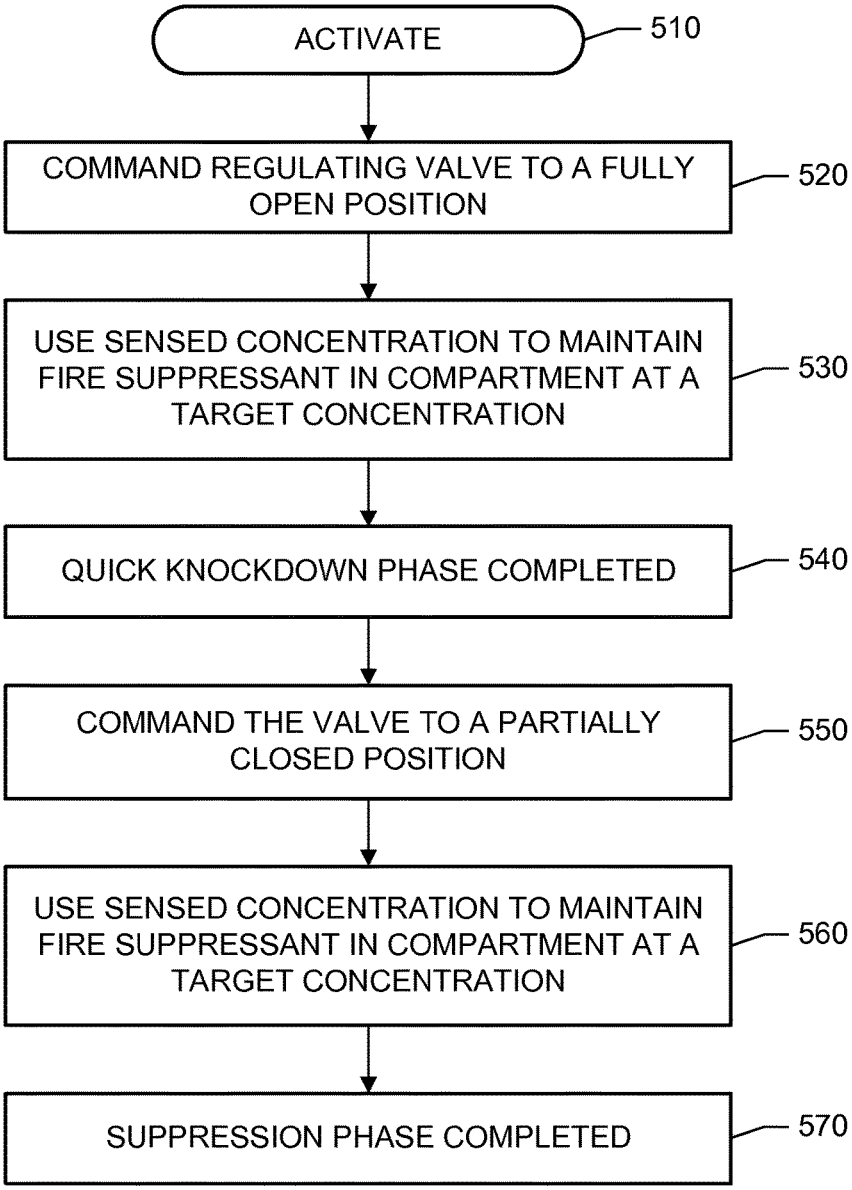

FIG. 5 illustrates the operation of the fire suppression system 310. The operation is similar to that of the fire suppression system 210 of FIG. 4, except that the quick knockdown phase is initiated by opening the regulating valve 340 to a fully open position instead of breaking the diaphragm 222. Thus, after the system 310 of FIG. 3 has been activated, the regulating valve 340 is commanded to a fully open position (block 520), and concentration of the fire suppressant in the compartment is maintained at a target concentration (block 530) until the knockdown phase has been completed (block 540). Then, the regulating valve 340 is commanded to a partially closed position (block 550), and concentration of the fire suppressant in the compartment is maintained at a target concentration (block 560) until the suppression phase has been completed (block 570).

In the examples illustrated in FIGS. 4 and 5, the suppressant concentration is controlled during both the quick knockdown and suppression phases. In some embodiments, however, the suppressant concentration may be controlled only during the suppression phase.

Figure 6:
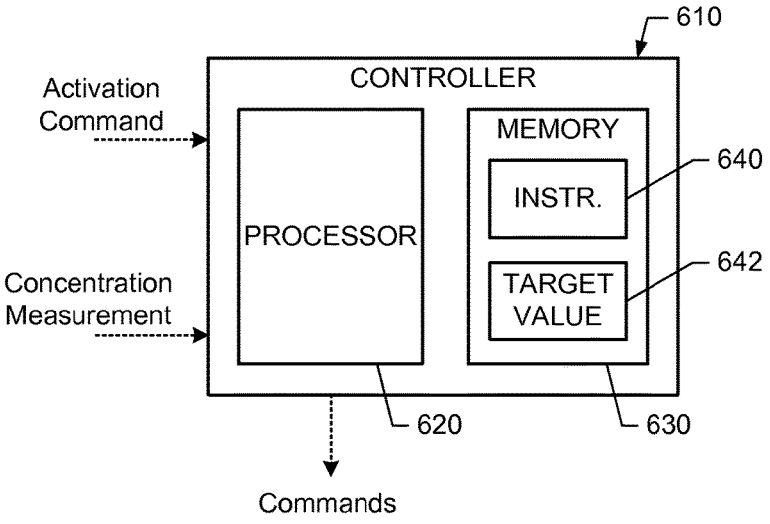
FIG. 6 is an illustration of an example of a controller for a fire suppression system.

Reference is now made to FIG. 6, which illustrates an example of a controller 610 for a fire suppression system herein. The controller 610 includes a processor 620 and memory 630 for storing data. The data includes instructions 640 that, when executed, cause the processor 620 to issue a command (e.g., a valve command, a pyrotechnic discharge head command) that initiates the quick knockdown phase in response to an activation command. The data may also include a target concentration value 642. The instructions 640 also cause the processor 620 to issue valve commands that initiate the suppression phase and that cause the regulating valve to maintain the measured concentration at the target concentration. In some embodiments, the controller 610 may implement a closed loop control, which compares the measured concentration to the target concentration value 642, and generates a valve command that adjusts the regulating valve so that the measured concentration approaches the target concentration value 642.

Figure 7:
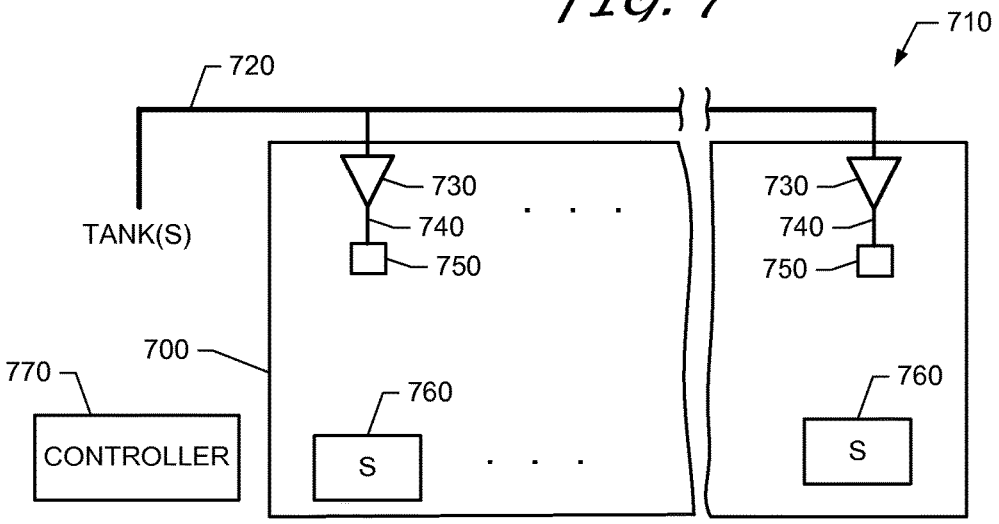
FIG. 7 is an illustration of another example of the fire suppression system.

Reference is now made to FIG. 7, which illustrates another example of a fire suppression system herein. The fire suppression system 710 of FIG. 7 performs a "zoned" discharge of fire suppressant into a compartment 700. The fire suppression system 710 includes a main conduit 720, a plurality of regulating valves 730 branching off the main conduit 720, and a plurality of secondary conduits 740. The main conduit 720 supplies fire suppressant to the valves 730. Each secondary conduit 740 extends from a corresponding valve 730 and terminates in a nozzle 750. The valves 730 may be placed near the nozzles 750, which may be located in the ceiling of the compartment 700. In some embodiments, the valves 730 may be normally closed valves. In other embodiments, the valves 730 may be normally open valves that are used in combination with sealed tanks.

The compartment has a plurality of zones. At least one nozzle 750 may be located within each zone. At least one concentration sensor 760 may also be located in each zone. A controller 770 receives measurements of fire suppressant concentration in each zone, and independently controls each valve 730 to maintain a target concentration in the corresponding zone.

In some embodiments, zones may be selected to cover the entire compartment. In other embodiments, zones may be selected to cover only certain areas of the compartment. The number of zones would increase with the total volume of the compartment and the complexity of the compartment geometry.

The zoned discharge of fire suppressant is advantageous for fire suppressants that are heavier than air. Such fire suppressants tend to concentrate near the compartment floor, and additionally tend to concentrate near the aft end of the compartment. Such a tendency can leave the top portion of the compartment with a relatively low concentration of fire suppressant. The zoned discharge can maintain the target concentration at the top of the compartment.

The zoned discharge is further advantageous for compartments having high leakage regions where localized concentrations may sink faster than other areas within the compartment. The zoned discharge can maintain the target concentration in those high leakage regions.

Figure 8A:
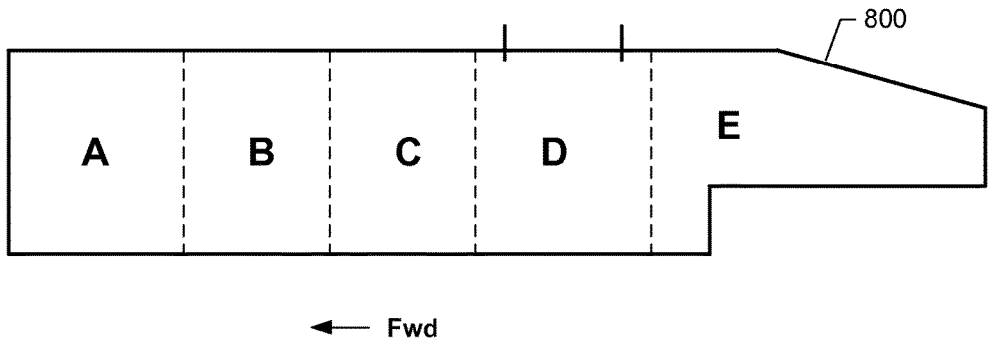
FIGS. 8*a* and 8*b* are illustrations of cargo compartments with different zone coverage.
Figure 8B:
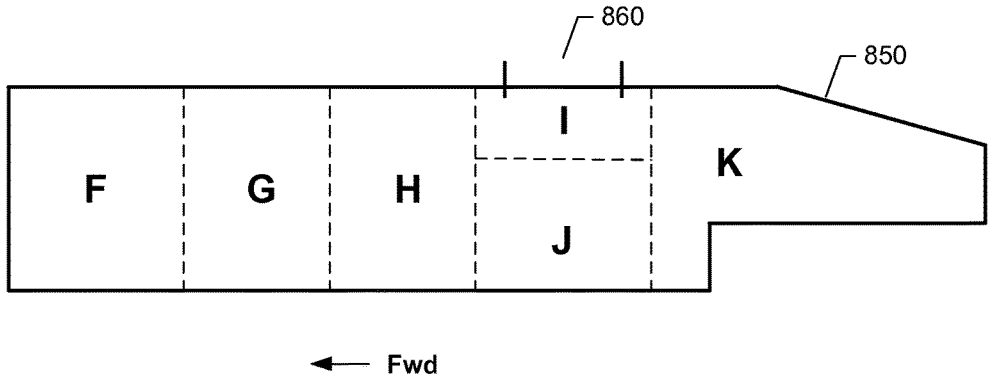

FIGS. 8*a* and 8*b* provide examples of compartments 800 and 850 having zones A to E and F to K that cover the upper portions. In the compartment 850 of FIG. 8*b*, however, an additional zone is provided near a cargo door 860. The cargo door 860 is a high leakage area, where localized concentrations may sink faster than other areas within the compartment 850.

For the compartments 800 and 850 of FIGS. 8*a* and 8*b*, a heavier-than-air fire suppressant may be supplied to the upper zones A-E and F-K only, and allowed to sink to the lower portion. Suppressant concentration in the upper zones may be controlled to a target concentration.

In some embodiments, at least one sensor is located in each zone. In other embodiments, at least one sensor is provided only in the zone or zones having the lowest likely concentrations. Suppressant concentration tends to increase moving down and aft. Therefore, at least one concentration sensor may be located in the upper forward zone A of the compartment (e.g., zone A of compartment 800 and zone F of compartment 850).

In some embodiments, all of the zones may be controlled to the same target concentration. However, since the zones are controlled independently, different zones may be controlled to different target concentrations.

Fire suppression herein will typically be performed until the aircraft lands. However, the flow of fire suppressant doesn't have to be continuous as long as minimum concentrations are maintained.

The invention claimed is:

1. An aircraft comprising:

a fuselage;

a compartment disposed in the fuselage, the compartment including a plurality of zones; and a fire suppression system for delivering fire suppressant to the compartment, the system including:

at least one suppressant concentration sensor located in each of the plurality of zones of the compartment;

a valve associated with each of the plurality of zones of the compartment for regulating flow of the fire suppressant to a corresponding zone of the compartment; and a controller, responsive to each of the sensors, for independently controlling each of the valves to maintain fire suppressant concentration within each corresponding zone of the compartment at a target concentration.

2. The aircraft of claim 1, wherein the fire suppression system further includes a sealed fire suppressant tank, and a device for opening the sealed tank so the fire suppressant can flow to the compartment.

3. The aircraft of claim 2, wherein the tank is sealed with a diaphragm, and wherein the device includes a pyrotechnic discharge head for breaking the diaphragm.

4. The aircraft of claim 2, wherein at least one of the valves is a normally-open valve, and wherein the controller is configured to cause the at least one of the valves to be fully open during an initial quick knockdown phase of operation and, after a predetermined time interval has elapsed, cause the at least one of the valves to be partially open during a suppression phase of operation.

5. The aircraft of claim 1, wherein at least one of the valves is a normally closed valve, and wherein the controller is configured to cause the at least one of the valves to open fully during an initial quick knockdown phase of operation and, after a predetermined time interval has elapsed, cause the at least one of the valves to be partially open during a suppression phase of operation.

6. The aircraft of claim 1, wherein the fire suppression system further includes a plurality of conduits, each conduit extending from a valve to a corresponding one of the zones and terminating in a nozzle, the nozzle located within the corresponding zone.

7. The aircraft of claim 1, wherein at least one of the sensors is located in a zone corresponding to a high leakage region of the compartment.

8. The aircraft of claim 1, wherein at least one of the sensors is located in an upper forward zone of the compartment.

9. A fire suppression system for delivering a fire suppressant to a compartment disposed in a fuselage of an aircraft, the compartment including a plurality of zones, the system comprising:

at least one suppressant concentration sensor located in each of the plurality of zones of the compartment;

at least one valve associated with each of the plurality of zones of the compartment for regulating flow of the fire suppressant to a corresponding zone of the compartment; and a controller, responsive to each of the sensors, for independently controlling each of valves to maintain fire suppressant concentration within each corresponding zone of the compartment at a target concentration.

10. The system of claim 9, further comprising a sealed fire suppressant tank, and a device for opening the sealed tank.

11. The system of claim 10, wherein the tank is sealed with a diaphragm, and wherein the device includes a pyrotechnic discharge head for breaking the diaphragm.

12. The system of claim 10, wherein at least one of the valves is a normally-open valve, and wherein the controller is configured to cause the at least one of the valves to be fully open for quick knockdown and, after the quick knockdown has been performed, cause the at least one of the valves to be partially open for suppression.

13. The system of claim 9, wherein at least one of the valves is a normally closed valve, and wherein the controller is configured to cause the at least one of the valves to open fully for quick knockdown and, after the quick knockdown has been performed, cause the at least one of the valves to be partially open for suppression.

14. The system of claim 9, further comprising a plurality of conduits, each conduit extending from one of the valves and terminating in a nozzle, which is located within a corresponding zone of the compartment.

* * * * *